United States Patent [19]

Peterson

[11] 4,305,211

[45] Dec. 15, 1981

[54] VACUUM DRYER

[76] Inventor: Paul E. Peterson, 8125 Tuscany Ave., Playa Del Rey, Calif. 90291

[21] Appl. No.: 122,014

[22] Filed: Feb. 19, 1980

[51] Int. Cl.[3] ..... F26B 11/04

[52] U.S. Cl. ..... 34/92; 34/133; 417/473; 417/529

[58] Field of Search ..... 34/92, 133; 417/269, 417/222, 473, 529

[56] References Cited

U.S. PATENT DOCUMENTS

| | | | |
|---|---|---|---|
| 2,555,821 | 6/1951 | Smith | 34/92 |
| 2,927,380 | 3/1960 | Olthuis | 34/133 |
| 2,984,088 | 5/1961 | Cooper | 34/77 |
| 3,221,564 | 12/1965 | Raymond | 417/269 |

*Primary Examiner*—Larry I. Schwartz
*Attorney, Agent, or Firm*—Matthew P. Lynch

[57] ABSTRACT

A dryer for the drying of clothing and other articles by use of a vacuum. A vacuum is applied to the internal chamber of the rotating drum by means of a swash plate which rotates simultaneously at an inclined angle with respect to the rotational axis of the drum. Suction assemblies, which include the use of one-way valve assemblies are provided between the internal chamber of the drum and the swash plate. A motor is to cause rotation of the drum which also simultaneously rotates the swash plate. The air and moisture particles from within the internal chamber of the drum are discharged into the ambient by the suction means.

8 Claims, 4 Drawing Figures

Fig. 1
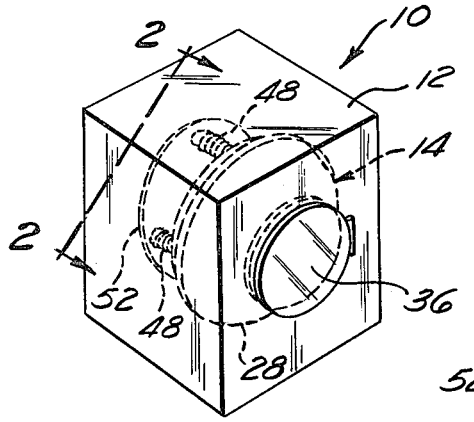
Fig. 2
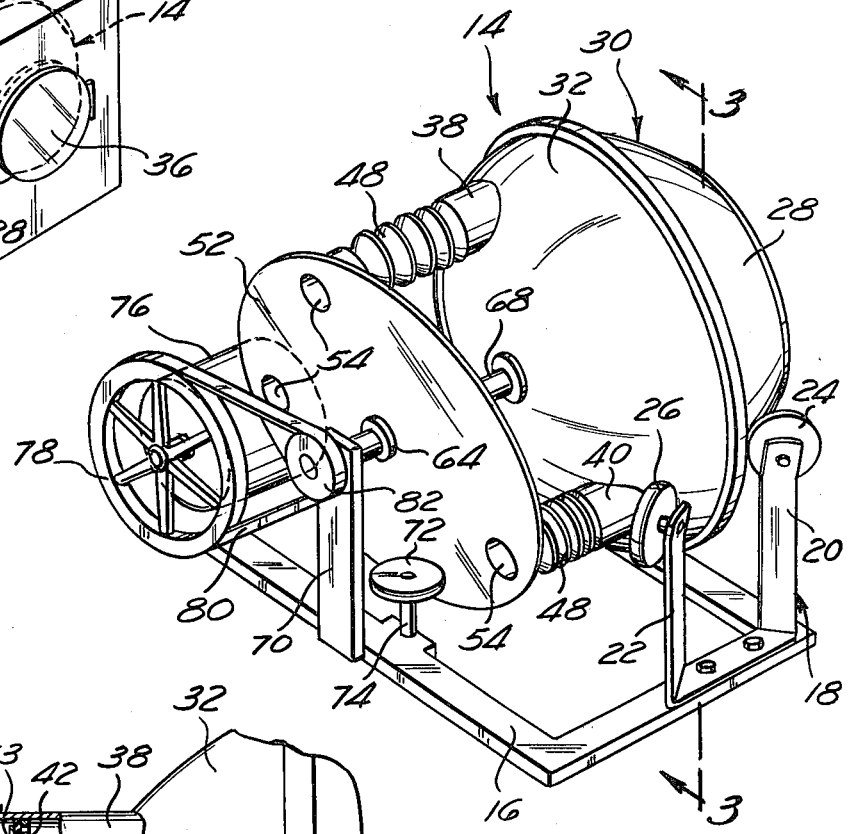
Fig. 4
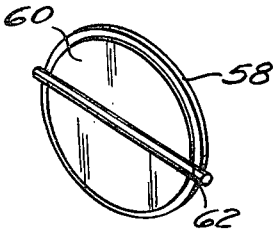
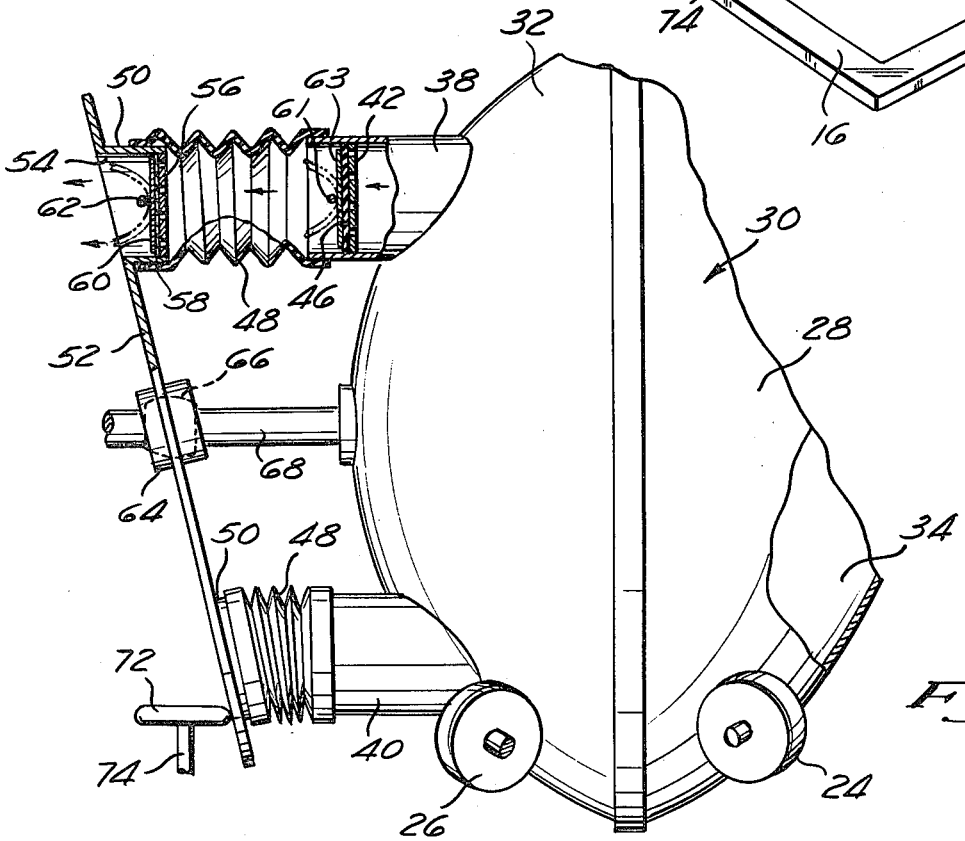
Fig. 3

VACUUM DRYER

BACKGROUND OF THE INVENTION

The field of this invention relates to an apparatus for drying fabrics, in particular clothing, or food stuffs, wherein the drying action is facilitated through the applying of a vacuum.

Clothes drying apparatuses have been known for a substantial period of time. The most common form of a clothes dryer is one which operates by tumbling the clothes in an enclosed drum while raising the temperature sufficiently to cause evaporation of the moisture from the clothes. While this type of dryer apparatus has been satisfactory, when considering the substantial number of such dryers being employed, there is required a substantial energy output to produce the heat that is being used by these dryers, as well as the electrical energy output required to operate the dryer.

Energy conservation is rapidly becoming of the utmost importance. If some type of clothes dryer could be constructed which did not employ the use of heat energy, or used very little, and which used a substantially lesser amount of energy in order to satisfactorily dry the clothes, that type of dryer would be most desirable.

In the past it has been known that applying of a vacuum to the wet clothes will cause substantial removal of the moisture in the clothes. The use of a vacuum for drying clothes is most advantageous. Firstly, the fibers of clothes which are softened by the washing process, are caused to expand in the vacuum and are dryed in the expanded condition which results in a softness and fluffiness not otherwise possible. Secondly, the non-application of heat (or small amount of heat) totally eliminates the possibility of scorching delicate fabrics. Thirdly, since the vacuum reaches into every portion of the clothes, there is no necessity for rapid drum rotation. The dry fibers are therefore not pounded into lint. This creation of lint causes the clothes to wear out more quickly. Fourthly, approximately one half of the moisture is vaporized and removed in the first quarter of drying time. The total drying time is less than one half of that required by conventional heat-applying dryers.

Previous attempts at designing a vacuum dryer apparatus have resulted in a substantially complexly constructed structure. Such a structure is difficult to manufacture, costly to manufacture and requires an increased amount of maintenance than conventional dryers.

A second major application for a vacuum facilitated dryer is the drying of foodstuff material, especially fruit and vegetable rind and pulp. These materials are very suitable for animal feeds and supplements when dried. In the wet state they are too heavy to transport and process and are prone to decay. Present thermal-drying techniques are cost-prohibitive at the low temperatures that would be required to avoid material breakdown.

SUMMARY OF THE INVENTION

The vacuum dryer of this invention is to include a drum which may be rotatably mounted on a plurality of low frictional rollers which are mounted on a frame. Support may also be facilitated by mounting the end of the shaft of rotation in a low-friction bearing assembly. The material to be dryed is to be placed within the drum. The drum is essentially air tight. The drum is rotatable about a first axis. A swash plate, (or wobble plate) is rotatably mounted about a second axis. The second axis intersects the first axis and is inclined in respect thereto. A plurality of conduits are connected to the drum and each are connected through a bellows assembly to the swash plate. Each conduit is capable of extracting air and moisture particles from the internal chamber and discharging such into the ambient. Associated with each bellows assembly and conduit are two one-way valve assemblys. The bellows for each conduit is located between each of a pair of spaced-apart one-way valves for each bellows-conduit assembly. Motor means is provided to cause rotation of the drum and also the swash plate.

The primary objective of this invention is to construct a dryer which facilitates the drying of materials by subjecting them to an environment of reduced pressure.

Another objective of this invention is to construct a dryer which requires less heat energy than is now used.

Another object of this invention is to construct a dryer which is composed of few parts arranged in a noncomplex manner, thereby minimizng the manufacturing cost, and making a vacuum-facilitated dryer commercially available at reasonable cost for the first time.

BRIEF DESCRIPTION OF THE DRAWING

FIG. 1 is an overall isometric view of the vacuum type clothes dryer of this invention as it would be embodied within an exterior housing;

FIG. 2 is an isometric view of the vacuum dryer of this invention without the exterior housing of FIG. 1;

FIG. 3 is a view, partially in cross-section, of the vacuum dryer of this invention taken along line 3—3 of FIG. 2; and FIG. 4 is an isometric view of a type of one-way valve assembly which is employed in conjunction with the vacuum dryer of this invention.

DETAILED DESCRIPTION OF THE SHOWN EMBODIMENT

Referring particularly to the drawing, there is shown the vacuum dryer 10 of this invention which is composed basically of an exterior housing 12 within which is contained the vacuum dryer operating structure 14 of this invention. The structure 14 is mounted on a rectangularly shaped metallic frame 16 which is attached to the inner surface of the exterior housing 12.

Fixedly attached by bolt-type fastening means on each side of the frame 16 is a pair of brackets 18 (only one being shown). Each bracket 18 is composed of a pair of bracket members 20 and 22. Low frictionally rotatably supported on the outer end of each of the bracket members 20 and 22, respectively are rollers 24 and 26. The rolling surface of the roller 24 is in contact with the front surface 28 of drum 30. The rolling surface of the roller 26 is in rolling contact with the rear surface 32 of the drum 30. The basic configuration of the drum 30 resembles that of a flattened sphere.

The drum 30 includes an internal chamber 34. The internal chamber 34 is to contain a quantity of material (not shown) to be dryed. An access door 36 is hingedly mounted within the front surface 28 in order to provide access into the internal chamber 34. When the access door 36 is shut, the internal chamber 34 is essentially air-tight.

It is to be understood that there is another set, as previously mentioned, of rollers, such as rollers 24 and 26 located on the opposite side of the drum 30. The result is that the drum 30 is resting totally on four in number low frictional rollers, which include the rollers 24 and 26.

Extending outwardly from the back surface 32 are a plurality of conduits, with conduits 38 and 40 being shown. It is to be understood that there can be more than two in number of conduits, the other conduits not being shown. It is to be understood that it is within the scope of this invention that the number of the conduits could be decreased or increased.

Each conduit, such as conduits 38 and 40, connects with the internal chamber 34. Mounted within the conduit 38 is a perforated plate 42. Lying against the outermost surface of the plate 42 is a rubber valve member 46. Against the member 46 is a thin, bendable metallic plate 63 which functions as a holding spring. The normal at-rest position of the valve member 46 is against the plate 42, held there by the holding pin 61. The plate 63, along with member 46, bends in a U-shape about pin 61 as is shown in phantom in FIG. 3. The function of the valve member 46 is that of a one-way valve wherein air and moisture particles are to be conducted from the internal chamber 34 through the perforated plate 42 and past the rubber valve 46 and into the bellows 48. A similar valve arrangement will be mounted within the conduit 40 and also within the conduits not shown. It is also be be understood that each of the conduits will be attached to a separate bellows 48.

The bellows 48 is to be constructed of a flexible resilient material, such as rubber, plastic or other similar type of material. The bellows 48 is basically corrugated and is capable of compressing in a lineal direction. This type of lineal direction compressing is clearly shown within FIG. 3. of the drawing.

The outer end of each bellows 48 is snugly attached onto an annular collar 50. It is to be understood that the inner end of each bellows 48 is snugly, air-tightly attached about its respective conduit, such as conduits 38 and 40. Each of the annular collars 50 are fixedly secured to a swash plate 52. There is to be a hole 54 formed within swash plate 52 in alignment with the interior of each annular collar 50.

Located within each annular collar 50 is a perforated plate 56. A rubber disc 58 is positioned against the perforated plate 56. A thin, metallic plate 60 is positioned against the rubber disc 58 as in the previously described valve. A rod 62 is in abutting contact with the outer surface of the metal plate 60. The ends of the rod 62 are secured to the annular collar 50. This foregoing structure is a similar one-way valve assembly, with it being understood that air and moisture droplets are to be capable of being pushed through the holes in the perforated plate 56, out past the periphery of the rubber valve 46 and into the ambient.

The swash plate 52 includes a centrally located sleeve 64. The sleeve 64 lies against a collar 66 which is fixedly secured to the drive shaft 68. The drive shaft is rotatably mounted on a bracket 70. The inner end of the drive shaft 68 is secured to the rear surface 32 of the drum 30.

It is to be noted by referring particularly to FIG. 3 of the drawing that the center axis passing through the sleeve 64 is perpendicular to the planar surface of the swash plate 52 and is inclined with respect to the center axis of the drive shaft 68. This inclination is to normally be approximately ten to twenty degrees. The swash plate 52 is maintained in this inclined position by having the swash plate 52 rest against a guide roller 72. The guide roller 72 is low frictionally mounted on a pin 74. The pin 74 is fixedly secured to the frame 16. Therefore, as the swash plate 52 is rotated, the inclined position of the swash plate 52 is maintained by the position of the guide roller 72.

Rotation of the drive shaft 68 is normally by means of an electrically operated motor 76. The motor 76 turns a drive pulley 78. The drive pulley 78 operates through a belt 80 to rotate a driven pulley 82. The driven pulley 82 is fixedly secured to the outermost end of the drive shaft 68.

The operation of the vacuum dryer 10 of this invention is as follows: Operation of the motor 76 causes the drive shaft 68 to rotate which also rotates the drum 30 upon the aforementioned four rollers with only rollers 24 and 26 being shown. Simultaneously therewith, the conduits, such as conduits 38 and 40 are rotated as well as the swash plate 32. This rotational movement causes the bellows 48 to function and to be compressed and expanded lineally.

Referring particularly to the compressed bellows 48 shown in FIG. 3 of the drawings, as the swash plate 52 rotates, the bellows 48 then expands. During this expansion, the rubber disc 58 closes the perforated plate 56. This means a vacuum is being created within the interior of the bellows 48. This creation of the vacuum causes the valve member 46 to move away from the plate 42 thereby permitting air and moisture particles from within the internal chamber 34 to be conducted through the conduit 38 and into the interior of the bellows 48.

Once the bellows 48 has been completely lineally expanded, further movement of the swash plate 52 causes the bellows 48 to begin contracting. At this time, the contracting motion causes the valve member 46 to re-seat itself against the plate 42 thereby sealing its perforations. Therefore, return of air and moisture particles from the interior of the bellows to the chamber 34 is prevented. However, at this time, the periphery of the disc 58 is deflected which causes the accumulated moisture particles and air within the bellows 48 to be discharged by being passed about the periphery of the disc 58 and into the ambient. This continues until bellows 48 is completely compressed and then the process is repeated.

What is claimed is:

1. A vacuum dryer comprising:

a drum having an internal chamber, an access door connected to said drum, said access door providing access into said internal chamber, said drum being rotatably mounted on support means, a rotatable drive shaft being attached to said drum for causing rotation of said drum, said drive shaft being rotatable about a first axis;

a plurality of conduits connected at one end thereof to said drum, said conduits connecting with said internal chamber;

a swash plate rotatable about a second axis, said swash plate being connected to the free end of said conduits, said second axis being inclined in respect to said first axis and intersects said first axis;

suction means connected between said swash plate and said conduits, said suction means becoming operable by rotation of said swash plate, said suction means to apply a vacuum into said internal chamber;

said suction means including a one-way valve assembly connected to each of said conduits; and said suction means further including a bellows assembly doubling as the wall of said conduits, said one-way valve assembly being located directly adjacent said bellows assembly.

2. The vacuum dryer as defined in claim 1 wherein:

said support means including a frame and a support roller assembly, said drum being rotatably mounted on said support roller assembly, said support roller assembly comprising a plurality of spaced apart roller units.

3. A vacuum dryer comprising:

a drum having an internal chamber, an access door connected to said drum, said access door providing access into said internal chamber, said drum being rotatably mounted on support means, a rotatable drive shaft being attached to said drum for causing rotation of said drum, said drive shaft being rotatable about a first axis;

a plurality of conduits connected to said drum, said conduits connecting with said internal chamber;

a swash plate rotatable about a second axis, said second axis being inclined in respect to said first axis;

suction means connected between said swash plate and said conduits, said suction means becoming operable by rotation of said swash plate, said suction means to apply a vacuum into said internal chamber; and said swash plate rests against a guide roller, said guide roller causes said second axis to be maintained at a fixed inclined position in respect to said first axis.

4. The vacuum dryer as defined in claim 3 wherein:

said conduits being equiangularly spaced apart in respect to said first axis, said second axis intersects said first axis.

5. The vacuum dryer as defined in claim 4 wherein:

said support means including a frame and a support roller assembly, said drum being rotatably mounted on said support roller assembly, said support roller assembly comprising a plurality of spaced apart roller units.

6. A vacuum dryer comprising:

a drum having an internal chamber, an access door connected to said drum, said access door providing access into said internal chamber, said drum being rotatably mounted on support means, a rotatable drive shaft being attached to said drum for causing rotation of said drum, said drive shaft being rotatable about a first axis;

a plurality of conduits connected at one end thereof to said drum, said conduits connecting with said internal chamber;

a swash plate rotatable about a second axis, said swash plate being connected to the free end of said conduits, said second axis being inclined in respect to said first axis and intersects said first axis; and suction means connected between said swash plate and said conduits, said suction means becoming operable by rotation of said swash plate, said suction means to apply a vacuum into said internal chamber, said suction means further including a bellows assembly doubling as the wall of said conduits.

7. The vacuum dryer as defined in claim 6 wherein:

said support means including a frame and a support roller assembly, said drum being rotatably mounted on said support roller assembly, said support roller assembly comprising a plurality of spaced apart roller units.

8. A vacuum dryer comprising:

a drum having an internal chamber, an access door connected to said drum, said access door providing access into said internal chamber, said drum being rotatably mounted on support means, a rotatable drive shaft being attached to said drum for causing rotation of said drum, said drive shaft being rotatable about a first axis;

a plurality of conduits connected to said drum, said conduits connecting with said internal chamber;

a swash plate rotatable about a second axis, said second axis being inclined in respect to said first axis;

suction means connected between said swash plate and said conduits, said suction means becoming operable by rotation of said swash plate, said suction means to apply a vacuum into said internal chamber, said suction means further including a bellows assembly; and said swash plate rests against a guide roller, said guide roller causes said second axis to be maintained at a fixed inclined position in respect to said first axis.

* * * * *